US011537070B2

(12) United States Patent
Adachi

(10) Patent No.: US 11,537,070 B2
(45) Date of Patent: Dec. 27, 2022

(54) HEATER, HEATING DEVICE, FIXING DEVICE, AND IMAGE FORMING APPARATUS

(71) Applicant: Tomoya Adachi, Kanagawa (JP)

(72) Inventor: Tomoya Adachi, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/355,463

(22) Filed: Jun. 23, 2021

(65) Prior Publication Data

US 2022/0004128 A1 Jan. 6, 2022

(30) Foreign Application Priority Data

Jul. 1, 2020 (JP) ..... JP2020-114095

(51) Int. Cl.
*G03G 15/20* (2006.01)

(52) U.S. Cl.
CPC ..... *G03G 15/2042* (2013.01); *G03G 15/2053* (2013.01); *G03G 15/2064* (2013.01); *G03G 2215/2038* (2013.01)

(58) Field of Classification Search
CPC ..... G03G 15/2053; G03G 15/2042; G03G 2215/2035
See application file for complete search history.

(56) References Cited

U.S. PATENT DOCUMENTS 9,372,463 B2 * 6/2016 Shimura ..... G03G 15/55
2019/0179242 A1 6/2019 Adachi et al.
2019/0196374 A1 6/2019 Adachi et al.
2019/0278206 A1 9/2019 Adachi et al.
2019/0286026 A1 9/2019 Furuichi et al.
2019/0286027 A1 9/2019 Someya et al.
2019/0286028 A1 9/2019 Furuichi et al.
2019/0286029 A1 9/2019 Adachi et al.
2020/0033766 A1 1/2020 Hase et al.
2020/0033767 A1 1/2020 Adachi et al.
2020/0033768 A1 1/2020 Furuichi et al.
2020/0033771 A1 1/2020 Furuichi et al.
2020/0033775 A1 1/2020 Inoue et al.
2020/0033776 A1 1/2020 Yoshinaga et al.
2020/0103796 A1 4/2020 Furuichi et al.
(Continued)

FOREIGN PATENT DOCUMENTS

JP 2010-276729 12/2010
JP 2013-037065 2/2013
(Continued)

*Primary Examiner* — Arlene Heredia

(74) *Attorney, Agent, or Firm* — Harness, Dickey & Pierce, P.L.C.

(57) ABSTRACT

A heater includes a base, a resistor pattern, and a circuit breaker. The resistor pattern includes a plurality of rows of resistors extending in a longitudinal direction of the base. The plurality of rows of resistors are spaced away from each other in a short-side direction orthogonal to the longitudinal direction of the base, coupled in parallel, and configured to generate heat by energization. The circuit breaker is disposed across the plurality of rows of resistors in the short-side direction and configured to cut off power supply to the resistor pattern when a temperature of any one of the plurality of rows of resistors reaches a high temperature threshold.

13 Claims, 10 Drawing Sheets

(56) References Cited

U.S. PATENT DOCUMENTS

| | | | |
|---|---|---|---|
| 2020/0103799 | A1 | 4/2020 | Adachi et al. |
| 2020/0103814 | A1 | 4/2020 | Someya et al. |
| 2020/0174408 | A1 | 6/2020 | Furuichi et al. |
| 2020/0249601 | A1 | 8/2020 | Inoue et al. |
| 2020/0249602 | A1 | 8/2020 | Inoue et al. |
| 2020/0249604 | A1 | 8/2020 | Adachi et al. |
| 2020/0292972 | A1 | 9/2020 | Inoue et al. |
| 2020/0292973 | A1 | 9/2020 | Furuichi et al. |
| 2020/0379384 | A1 | 12/2020 | Samei et al. |
| 2020/0387096 | A1 | 12/2020 | Adachi et al. |
| 2020/0401067 | A1 | 12/2020 | Samei et al. |

FOREIGN PATENT DOCUMENTS

| | | |
|---|---|---|
| JP | 2016-006499 | 1/2016 |
| JP | 2017-092039 | 5/2017 |
| WO | WO2013/073276 A1 | 5/2013 |

* cited by examiner

HEATER, HEATING DEVICE, FIXING DEVICE, AND IMAGE FORMING APPARATUS

CROSS-REFERENCE TO RELATED APPLICATION

This patent application is based on and claims priority pursuant to 35 U.S.C. § 119(a) to Japanese Patent Application No. 2020-114095, filed on Jul. 1, 2020, in the Japan Patent Office, the entire disclosure of which is incorporated by reference herein.

BACKGROUND

Technical Field

Embodiments of the present disclosure relate to a heater, a heating device, a fixing device, and an image forming apparatus. Specifically, the embodiments of the present disclosure relate to a heater including a resistor pattern through which a current flows to generate heat and a heating device including the heater, a fixing device including the heater, and an image forming apparatus including the heater.

Related Art

Electrophotographic image forming apparatuses use various types of fixing devices. In one type of fixing devices, a heater directly heats a thin fixing belt having a low thermal capacity. The heater includes a base and a resistor pattern that is a planar heater. The fixing device includes a pressure roller as a pressure rotator disposed outside the fixing belt, and the pressure roller is pressed against the heater via the fixing belt to form a fixing nip.

SUMMARY

This specification describes an improved heater that includes a base, a resistor pattern, and a circuit breaker. The resistor pattern includes a plurality arms of resistors extending in a longitudinal direction of the base. The plurality of rows of resistors are spaced away from each other in a short-side direction orthogonal to the longitudinal direction of the base, coupled in parallel, and configured to generate heat by energization. The circuit breaker is disposed across the plurality of rows of resistors in the short-side direction and configured to cut off power supply to the resistor pattern when a temperature of any one of the plurality of rows of resistors reaches a high temperature threshold.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
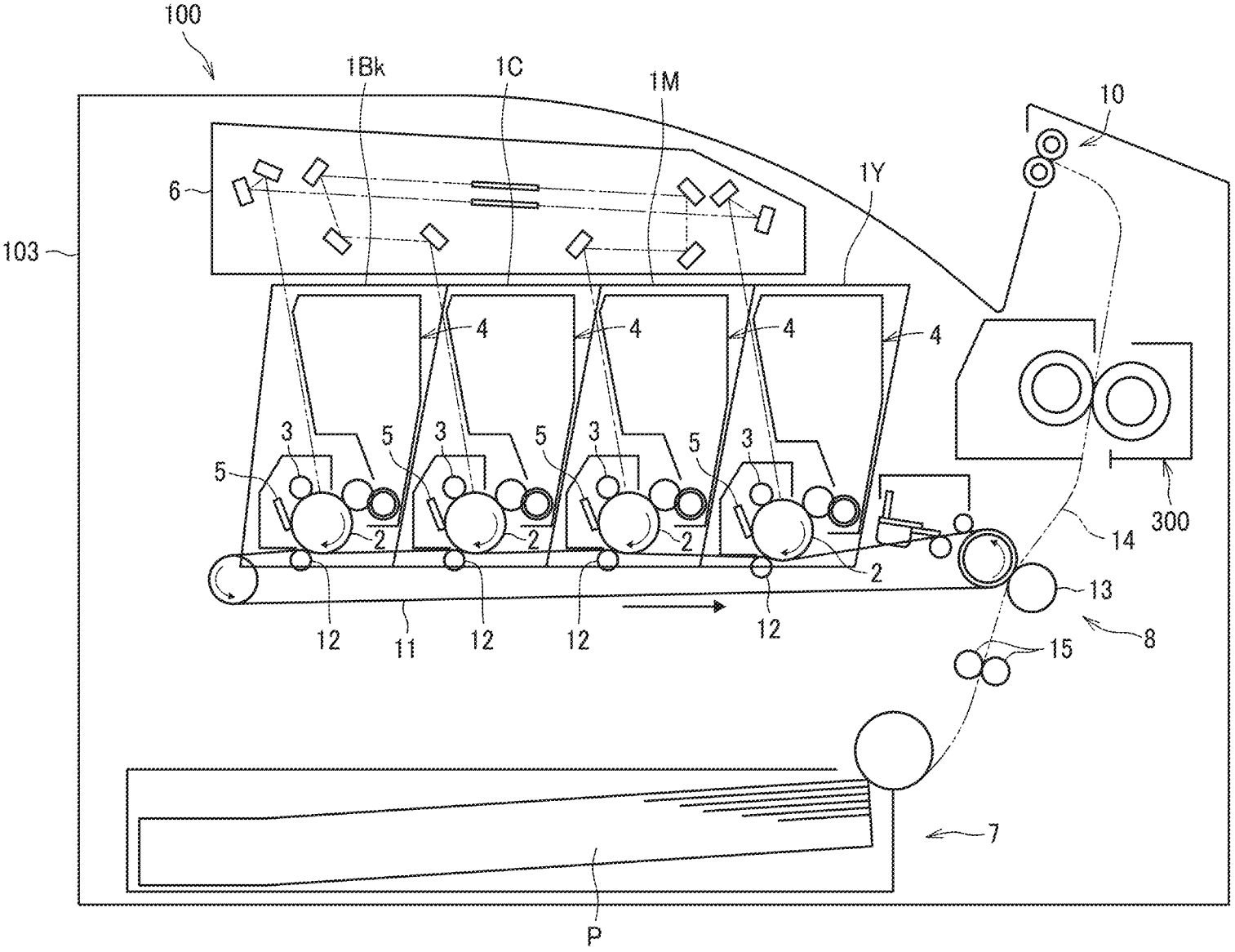
FIG. 1 is a schematic cross-sectional view of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Referring now to the drawings, embodiments of the present disclosure are described below. As used herein, the singular forms "a," "an," and "the" are intended to include the plural forms as well, unless the context clearly indicates otherwise. Identical reference numerals are assigned to identical components or equivalents and a description of those components is simplified or omitted.

With reference to drawings, a description is given of a heater, a fixing device using the heater, and an image forming apparatus such as a laser printer using the fixing device, according to embodiments of the present disclosure. The laser printer is just an example of the image forming apparatus, and thus the image forming apparatus is not limited to the laser printer. That is, the image forming apparatus may be a copier, a facsimile machine, a printer, a plotter, and a multifunction peripheral having at least two of copying, printing, facsimile transmission, plotting, and scanning capabilities; or an inkjet recording apparatus.

The identical or similar parts in each drawing are designated by the same reference numerals, and the duplicate description thereof is appropriately simplified or omitted. The dimensions, material, shape, and relative position in a description for each constituent component are examples. Unless otherwise specifically described, the scope of the present disclosure is not limited to those.

Although a "recording medium" is described as a "sheet" in the following embodiments, the "recording medium" is not limited to the sheet. Examples of the "recording medium" include not only the sheet but also an overhead projector (OHP) transparency, a fabric, a metallic sheet, a plastic film, and a prepreg sheet including carbon fibers previously impregnated with resin.

Examples of the "recording medium" include all media to which developer or ink can adhere, and so-called recording paper and recording sheets. Examples of the "sheet" include thick paper, a postcard, an envelope, thin paper, coated paper (e.g., coat paper and art paper), and tracing paper, in addition to plain paper.

The term "image formation" indicates an action for providing (i.e., printing) not only an image having a meaning, such as texts and figures on a recording medium, but also an image having no meaning, such as patterns on a recording medium.

A configuration of an image forming apparatus according to an embodiment of the present disclosure is described below.

FIG. 1 is a schematic cross-sectional view of the image forming apparatus 100 according to the present embodiment. The image forming apparatus 100 is a printer. Alternatively, the image forming apparatus according to an embodiment of the present disclosure may be a copier, a facsimile machine, a multifunction peripheral (MFP) having at least two of printing, copying, facsimile, scanning, and plotter functions, or the like.

As illustrated in FIG. 1, the image forming apparatus 100 includes four image forming units 1Y, 1M, 1C, and 1Bk serving as image forming devices, respectively. The image forming units 1Y, 1M, 1C, and 1Bk are removably installed in a main body 103 of the image forming apparatus 100. The image forming units 1Y, 1M, 1C, and 1Bk have a similar configuration except that the image forming units 1Y, 1M, 1C, and 1Bk contain developers in different colors, that is, yellow, magenta, cyan, and black, respectively, which correspond to color separation components for a color image.

Specifically, each of the image forming units 1Y, 1M, 1C, and 1Bk includes a photoconductor 2 that is drum-shaped and serves as an image bearer, a charging device 3 to charge a surface of the photoconductor 2, a developing device 4 to supply toner as a developer to the surface of the photoconductor 2 to form a toner image, and a photoconductor cleaner 5 to clean the surface of the photoconductor 2.

The image forming apparatus 100 further includes an exposure device 6 to expose the surface of each photoconductor 2 to form an electrostatic latent image, a sheet feeder 7 to supply a sheet P as a recording medium, a transfer device 8 to transfer the toner image formed on each photoconductor 2 onto the sheet P, a fixing device 300 to fix the transferred toner image onto the sheet P, and an output device 10 to eject the sheet P outside the image forming apparatus 100.

The transfer device 8 includes an intermediate transfer belt 11, four primary transfer rollers 12, and a secondary transfer roller 13. The intermediate transfer belt 11 is an endless belt serving as an intermediate transferor stretched taut across a plurality of rollers. The four primary transfer rollers 12 serve as primary transferors that transfer yellow, magenta, cyan, and black toner images formed on the photoconductors 2 onto the intermediate transfer belt 11, respectively, thus forming a full color toner image on the intermediate transfer belt 11. The secondary transfer roller 13 serves as a secondary transferor that transfers the full color toner image formed on the intermediate transfer belt 11 onto the sheet P. The plurality of primary transfer rollers 12 is pressed against the photoconductors 2, respectively, via the intermediate transfer belt 11.

Thus, the intermediate transfer belt 11 contacts each of the photoconductors 2, forming a primary transfer nip therebetween. On the other hand, the secondary transfer roller 13 is pressed against one of the rollers across which the intermediate transfer belt 11 is stretched taut via the intermediate transfer belt 11. Thus, a secondary transfer nip is formed between the secondary transfer roller 13 and the intermediate transfer belt 11.

The image forming apparatus 100 accommodates a sheet conveyance path 14 through which the sheet P fed from the sheet feeder 7 is conveyed. A timing roller pair 15 is disposed in the sheet conveyance path 14 at a position between the sheet feeder 7 and the secondary transfer nip defined by the secondary transfer roller 13.

Referring to FIG. 1, a description is provided of printing processes performed by the image forming apparatus 100 having the configuration described above.

When the image forming apparatus 100 receives an instruction to start printing, a driver drives and rotates the photoconductor 2 clockwise in FIG. 1 in each of the image forming units 1Y, 1M, 1C, and 1Bk. The charging device 3 charges the surface of the photoconductor 2 uniformly at a high electric potential. Subsequently, the exposure device 6 exposes the surface of each of the photoconductors 2 based on image data created by an original scanner that reads an image on an original or print data instructed by a terminal, thus decreasing the electric potential of an exposed portion on the photoconductor 2 and forming an electrostatic latent image on the photoconductor 2. The developing device 4 supplies toner to the electrostatic latent image formed on the photoconductor 2, forming a toner image thereon.

When the toner images formed on the photoconductors 2 reach the primary transfer nips defined by the primary transfer rollers 12 in accordance with rotation of the photoconductors 2, the toner images formed on the photoconductors 2 are transferred onto the intermediate transfer belt 11 driven and rotated counterclockwise in FIG. 1 successively such that the toner images are superimposed on the intermediate transfer belt 11, forming a full color toner image thereon. Thereafter, the full color toner image formed on the intermediate transfer belt 11 is conveyed to the secondary transfer nip defined by the secondary transfer roller 13 in accordance with rotation of the intermediate transfer belt 11 and is transferred onto the sheet P conveyed to the secondary transfer nip.

The sheet P is fed from the sheet feeder 7. The timing roller pair 15 temporarily stops the sheet P fed from the sheet feeder 7 and conveys the sheet P to the secondary transfer nip, timed to coincide with the toner image on the intermediate transfer belt 11. Thus, a full-color toner image is formed on the sheet P. After the toner image is transferred from each of the photoconductors 2 onto the intermediate transfer belt 11, each of the photoconductor cleaners 5 removes residual toner on each of the photoconductors 2.

After the toner image is transferred onto the sheet P, the sheet P is conveyed to the fixing device 300 to fix the toner image on the sheet P. Thereafter, the output device 10 ejects the sheet P onto the outside of the image forming apparatus 100, thus finishing a series of printing processes.

How the image forming apparatus 100 according to the embodiment operates is described below.

Figure 2A:
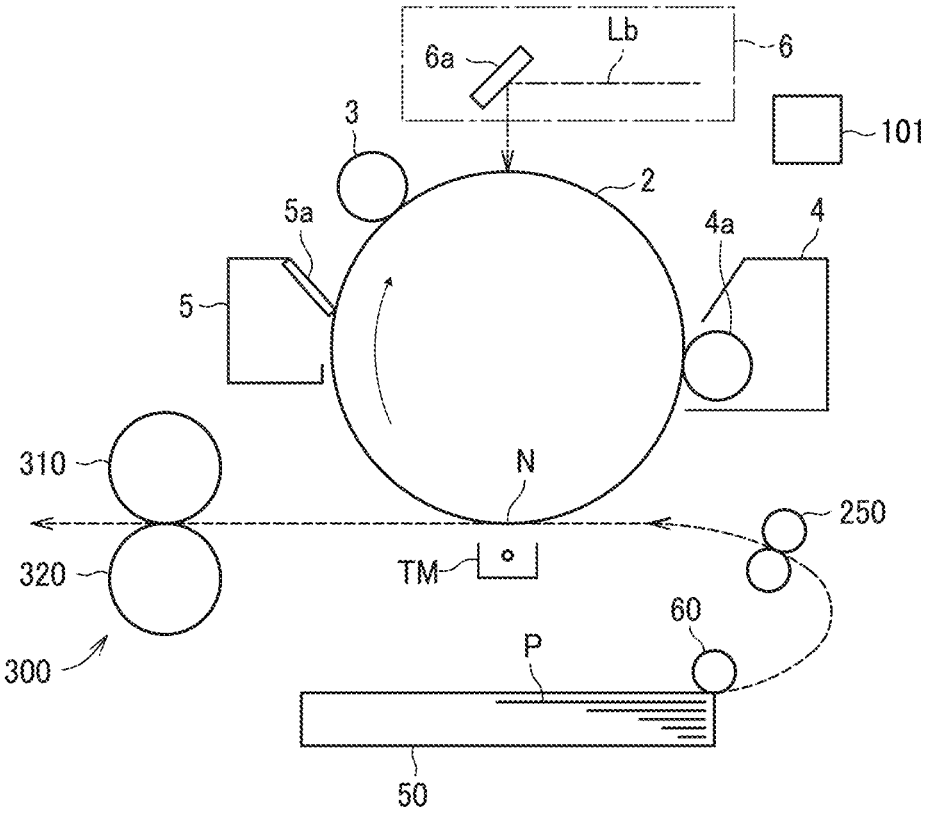
FIG. 2A is a schematic diagram illustrating the principle of how an image forming apparatus operates, according to an embodiment of the present disclosure.

The image forming apparatus 100 is a laser printer and includes the fixing device 300 according to the embodiment. FIG. 2A is a schematic diagram illustrating the principle of how the image forming apparatus 100 operates. The image forming apparatus 100 includes the photoconductor 2 as the image bearer such as a photoconductor drum and a photoconductor cleaner 5. The image forming apparatus 100 further includes a charging device 3 as a charger that uniformly charges the surface of the photoconductor 2 as the image bearer, a developing device 4 as a developing unit that renders visible an electrostatic latent image on the photoconductor 2 as the image hearer, a transfer device TM disposed under the photoconductor 2 as the image bearer, a discharger, and the like.

The exposure device 6 is disposed above the photoconductor 2 as the image bearer. The exposure device 6 performs writing and scanning based on image data, that is to say, irradiates the photoconductor 2 as the image bearer with laser light Lb emitted by a laser diode based on image data and reflected by a mirror 6*a*.

A sheet feeder 50 including a tray loaded with sheets P is disposed in a lower portion of the image forming apparatus 100. The sheet feeder 50 is configured as a recording-medium supply device and can store a bundle of many recording media sheets P. The sheet feeder 50 is configured as one unit together with a sheet feeding roller 60 as a conveyor for the sheets P.

Downstream from the sheet feeding roller 60, a registration roller pair 250 as a separation and conveyance means is disposed. The registration roller pair 250 temporarily stops the sheet P fed from the sheet feeder 50. Temporarily stopping the sheet P causes slack on the leading-edge side of the sheet P and corrects a skew of the sheet P.

The registration roller pair 250 sends the sheet P contacting the registration roller pair 250 and having the slack on the leading-edge side toward a transfer nip of the transfer device TM at a timing to suitably transfer a toner image on the photoconductor 2 as the image bearer onto the sheet P. A bias applied at the transfer nip N electrostatically transfers the toner image formed on the photoconductor 2 as the image bearer onto the sent sheet P at a desired transfer position.

The fixing device 300 is disposed downstream from the transfer nip N. The fixing device 300 includes a fixing belt 310 as a fixing rotator heated by a resistor pattern made of resistors 332 and a pressure roller 320 as a pressure rotator that rotates while contacting the fixing belt 310 with a predetermined pressure.

Next, operations of the image forming apparatus 100 according to the present embodiment are described below.

The sheet feeding roller 60 rotates in response to a sheet feeding signal from a controller 101 of the image forming apparatus 100. The sheet feeding roller 60 rotates to separate the uppermost sheet from a bundle of sheets P loaded in the sheet feeder 50 and send the uppermost sheet out to a sheet feeding path.

When the leading edge of the sheet P sent by the sheet feeding roller 60 reaches a nip of the registration roller pair 250, the sheet P forms slack and temporarily stops. The registration roller pair 250 corrects the front-end skew of the sheet P and rotates in synchronization with an optimum timing to transfer the toner image on the photoconductor 2 as the image bearer onto the sheet P.

The charging device 3 uniformly charges the surface of the photoconductor 2 as the image bearer to high potential. The exposure device 6 irradiates the surface of the photoconductor 2 as the image bearer with the laser light Lb based on the image data and reflected by the mirror 6*a*.

The surface of the photoconductor 2 as the image bearer irradiated with the laser light Lb has the electrostatic latent image due to a drop in the potential of the irradiated portion. The developing device 4 includes a developer bearer 4*a* bearing a developer including toner and transfers unused black toner supplied from a toner bottle to the surface portion of the photoconductor 2 as the image bearer having the electrostatic latent image, through the developer bearer 4*a*.

The photoconductor 2 as the image bearer to which the toner has been transferred forms (develops) a black toner image on the surface of the photoconductor 2 as the image bearer. The transfer device TM transfers the black toner image formed on the photoconductor 2 as the image bearer onto the sheet P.

A cleaning blade 5*a* in the photoconductor cleaner 5 removes the residual toner adhering to the surface of the photoconductor 2 as the image bearer after a transfer process. The removed residual toner is collected to a waste toner container.

The sheet P bearing the toner image is conveyed to the fixing device 300. The sheet P conveyed to the fixing device 300 is sandwiched by the fixing belt 310 and the pressure roller 320. Then, heating and pressing fixes the unfixed toner image onto the sheet P. The sheet P fixed the toner image is sent out from the fixing device 300.

Next, a configuration of the fixing device 300 is described.

Figure 2B:
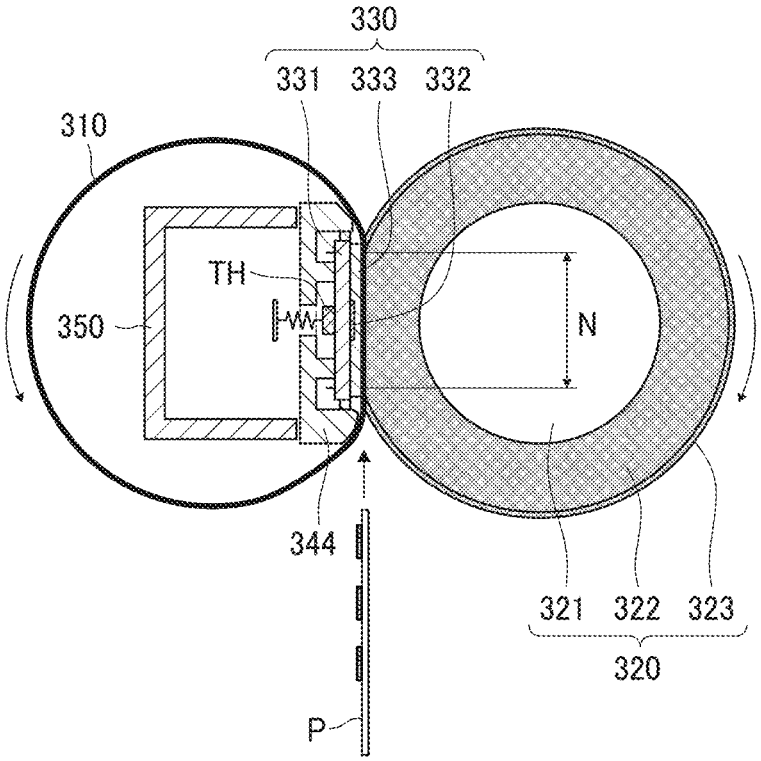
FIG. 2B is a schematic cross-sectional view of a fixing device incorporated in the image forming apparatus depicted in FIG. 1.

As illustrated in FIG. 2B, the fixing device 300 as a hating device according to the present embodiment includes the fixing belt 310, the pressure roller 320, and a heater 330. The fixing belt 310 is an endless belt serving as the fixing rotator, a heating rotator, or a fixing member. The pressure roller 320 serves as a pressure rotator, an opposed rotator or an opposed member that contacts an outer circumferential surface of the fixing belt 310 to form a fixing nip N between the fixing belt 310 and the pressure roller 320. The heater 330 heats the fixing belt 310. The heater 330 is held by a heater holder 344, and the heater holder 344 is reinforced in a longitudinal direction by a stay 350 as a reinforcement.

The fixing belt 310 is a flexible sleeve-shaped rotator and includes, for example, a tubular base made of polyimide (PI), the tubular base having an outer diameter of 25 mm and a thickness of from 40 to 120 μm. The fixing belt 310 includes a release layer serving as an outermost surface layer. The release layer is made of fluororesin, such as tetrafluoroethylene-perfluoroalkylvinylether copolymer (PFA) and polytetrafluoroethylene (PTFE), and has a thickness of from 5 μm to 50 μm to enhance durability of the fixing belt 310 and facilitate separation of the sheet P from the fixing belt 310.

An elastic layer made of rubber having a thickness of from 50 to 500 μm may be interposed between the base and the release layer. The base of the fixing belt 310 may be made of heat-resistant resin such as polyetheretherketone (PEEK) or metal such as nickel (Ni) or stainless steel (Stainless Used Steel, SUS), instead of polyimide. The inner circumferential surface of the fixing belt 310 may be coated with polyimide or polytetrafluoroethylene (PTFE) as a slide layer.

The pressure roller 320 having, for example, an outer diameter of 25 mm, includes a solid iron cored bar 321, an elastic layer 322 on the surface of the cored bar 321, and a release layer 323 formed on the outside of the elastic layer 322. The elastic layer 322 is made of silicone rubber and has, for example, a thickness of 3.5 mm. Preferably, the release layer 323 is formed by a fluororesin layer having, for example, a thickness of approximately 40 μm on the surface of the elastic layer 322 to improve releasability.

A detailed description is now given of a construction of the heater 330. The heater 330 extends in a longitudinal direction thereof throughout an entire width of the fixing belt 310 in a width direction, that is, an axial direction, of the fixing belt 310. The heater 330 contacts the inner circumferential surface of the fixing belt 310. The heater 330 may not contact the fixing belt 310 or may be disposed opposite the fixing belt 310 indirectly via a low-friction sheet or the like. However, the heater 330 that contacts the fixing belt 310 directly enhances conduction of heat from the heater 330 to the fixing belt 310.

The heater 330 may contact the outer circumferential surface of the fixing belt 310. However, if the outer circumferential surface of the fixing belt 310 is brought into contact with the heater 330 and damaged, the fixing belt 310 may degrade quality of fixing the toner image on the sheet P. Hence, the heater 330 contacts the inner circumferential surface of the fixing belt 310 advantageously.

The heater 330 includes the base 331, and the resistor pattern made of the resistors 332 and an insulation layer 333 laminated on a surface of the base 331 nearer to the nip N than the other surface of the base 331.

The base 331 may be made of, for example, ceramic such as alumina or aluminum nitride. The base 331 made of ceramic has an advantage that the base 331 made of ceramic reduces a shearing force applied to the resistor pattern made of the resistors 332 because the shearing force is caused by the difference between a thermal expansion amount of the base 331 and a thermal expansion amount of the insulation layer 333, and if the insulation layer 333 is made of grass, the difference is small because ceramic has a linear expansion coefficient close to that of glass.

In addition, the base 331 made of ceramic has an advantage that the base 331 made of ceramic easily conduct heat to the fixing belt 310 because the thermal conductivity of ceramic is higher than that of metal such as stainless steel. As the material of the base 331, glass, mica, or the like is also preferable because of their excellent heat resistance and insulating property, in addition to ceramic. The heater 330 according to the present embodiment uses an alumina base having a lateral width of 8 mm, a longitudinal width of 270 mm, and a thickness of 1.0 mm.

A detailed description is now given of a configuration of the heater holder 344 and the stay 350. The heater holder 344 and the stay 350 are disposed inside a loop formed by the fixing belt 310. The stay 350 includes a channel made of metal. Both lateral ends of the stay 350 in a longitudinal direction thereof are supported by side walls of the fixing device 300, respectively.

The stay 350 supports a stay side of the heater holder 344. The stay side of the heater holder 344 is a surface facing the stay 350 away from the heater 330. Accordingly, the stay 350 supports the heater holder 344 while retaining the heater 330 and the heater holder 344 to be immune from being bent substantially by pressure from the pressure roller 320. Thus, the fixing nip N is stably formed between the fixing belt 310 and the pressure roller 320.

Since the heater holder 344 is subject to temperature increase by heat from the heater 330, the heater holder 344 is preferably made of a heat-resistant material. For example, the heater holder 344 is made of heat-resistant resin having low thermal conduction, such as a liquid crystal polymer (LCP) or polyether ether ketone (PEEK) and reduces heat transfer from the heater 330 to the heater holder 344 and provides efficient heating of the fixing belt 310.

A spring serving as a biasing member causes the fixing belt 310 and the pressure roller 320 to press against each other. Thus, the nip N is formed between the fixing belt 310 and the pressure roller 320. As a driving force is transmitted to the pressure roller 320 from a driver disposed in the main body 103 of the image forming apparatus 100, the pressure roller 320 serves as a drive roller that drives and rotates the fixing belt 310.

The fixing belt 310 is thus driven and rotated by the pressure roller 320 as the pressure roller 320 rotates. While the fixing belt 310 rotates, the fixing belt 310 slides on the heater 330. Therefore, in order to facilitate sliding performance of the fixing belt 310, a lubricant such as oil or grease may be provided between the heater 330 and the fixing belt 310.

When printing starts, the driver drives and rotates the pressure roller 320, and the fixing belt 310 starts rotating with the rotation of the pressure roller 320. The heater 330 is supplied with power, heating the fixing belt 310. When the temperature of the fixing belt 310 reaches a predetermined target temperature called a fixing temperature, as illustrated in FIG. 2B, the sheet P bearing an unfixed toner image is conveyed to the nip N between the fixing belt 310 and the pressure roller 320, and the unfixed toner image is heated and pressed onto the sheet P and fixed thereon.

The heater according to a first embodiment is described below.

Figure 3A:
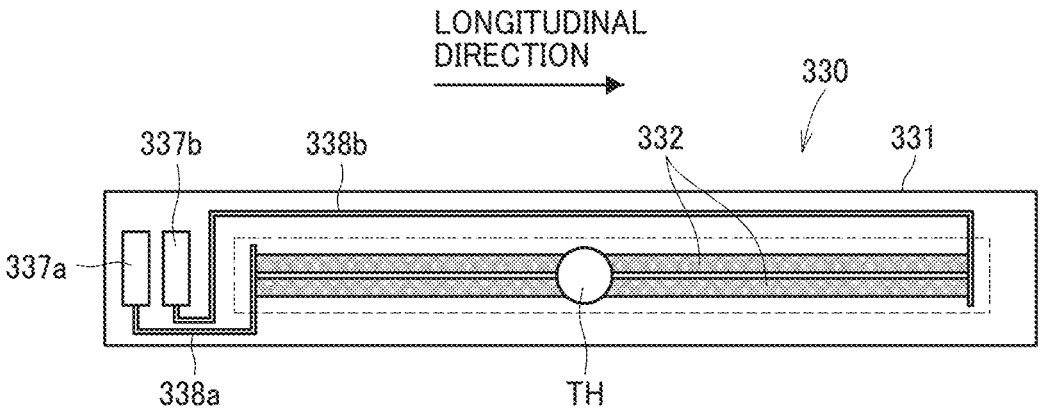
FIG. 3A is a plan view of a heater according to a first embodiment of the present disclosure.

FIG. 3A is a plan view of the heater 330 according to the first embodiment. As illustrated in FIG. 3A, the heater 330 includes the base 331. The resistor pattern includes two resistors 332 formed as two straight lines parallel to the longitudinal direction of the base 331. The two resistors generate heat when the resistors are energized.

The two rows of resistors 332 are spaced apart from each other in a short-side direction orthogonal to the longitudinal direction of the base 331 and are connected in parallel to the electrodes 337*a* and 337*b* as described later. A rectangular region indicated by a dashed line in FIG. 3A is a heating region corresponding to the nip N.

Dimensions and resistance values of the two rows of resistors 332 are as follows in the present embodiment.

A width of the resistor 332 in the short-side direction: 2.0 mm

An interval between the two resistors 332 in the short-side direction: 0.7 mm A width of the resistor pattern in the short-side direction: 4.7 mm (=2.0×2+0.7)

A resistance value of the resistor 332: 16 Ω

A width of the resistor 332 in the longitudinal direction: 216 to 220 mm

The two rows of resistors 332 can be formed by, for example, applying a resistive material paste prepared by mixing silver-palladium (AgPd), glass powder, or the like to the base 331 by screen printing or the like, and then firing the base 331. Alternatively, the resistive material may be a silver alloy (AgPt) and ruthenium oxide ($RuO_2$).

The two rows of resistors 332 do not necessarily have to be linear as illustrated in FIG. 3A. Instead of the linear shape, the shape of the resistor 332 may be a form including waveforms continuously connected. The above-described form can lengthen the resistor 332 and reduce the specific resistance of the resistive material paste.

Two electrodes 337*a* and 337*b* are disposed on one end portion of the base 331 in the longitudinal direction of the base 331 and coupled to an AC power supply. A small conductor 338*a* having a resistance value smaller than that of the resistors 332 couples one electrode 337*a* and ends of the two rows of resistors 332. Similarly, a conductor 338*b* having a resistance value smaller than that of the resistor 332 couples the other electrode 337*b* and the other ends of the two rows of resistors 332.

A thermostat TH is disposed at the center of the two rows of resistors 332 in the longitudinal direction of the two rows of resistors 332 and serves as a circuit breaker that cuts off power supply to the resistors 332. The thermostat TH is disposed across two rows of the resistors 332 in the short-side direction of the base 331 or the resistors 332.

The thermostat TH cuts off power supply to the resistors 332 for safety when the temperature of any one of the two rows of resistors 332 reaches a high temperature threshold (for example, higher than 180° C. and lower than 200° C.). The above-described "The thermostat TH is disposed across two rows of the resistors 332" means that the thermostat TH entirely or partially overlaps with both of the two rows of resistors 332 in the short-side direction in plan view in which the two rows of resistors 332 are viewed from the thickness direction.

In addition to the thermostat TH, a thermistor as a temperature detector is also disposed to face the two rows of resistors 332. At least two thermistors face the two rows of resistors 332 at least two positions of resistors 332 in the longitudinal direction of the resistors 332. The thermistors disposed at the two positions detect the temperatures of the resistors 332 at the two positions. That is, in FIG. 3A, one of the thermistors faces the center portion of the resistors 332 in the longitudinal direction of the two rows of resistors 332. In addition, the other one of the thermistors faces either the right end portion of the resistors 332 or the left end portion of the resistors 332.

When the fixing device 300 is operated, using the thermistor facing the center portion of the resistors 332 enables a heat controller included in the controller 101 to control and maintain the temperature of the fixing belt 310 at a desired fixing temperature (for example, 170° C.). Note that "detecting the temperature of the resistors 332" means not only directly measuring the temperatures of the resistors 332 with a sensor or the like but also estimating the temperature based on some parameter.

An elastic member such as a spring presses each of the thermostat TH and the thermistor against the base 331. The pressure due to the spring reduces a contact gap between the thermostat TH and the base 331 and a contact gap between the thermistor and the base 331. Therefore, the accurate temperature of the resistor 332 is transmitted to the thermostat TH, and the thermistor can detect the accurate temperature of the resistor 332.

In FIG. 3A, the thermostat disposed at the center portion of the resistors 332 in the longitudinal direction of the resistors 332 and the thermistor are disposed in a range corresponding to the minimum sheet width in the image forming apparatus. In addition, the thermistor disposed at either the right end portion or the left end portion of the resistor 332 is disposed at an end portion in a sheet conveyance span corresponding to the maximum sheet width. Regardless of the sheet size, the toner image borne on the sheet is fixed onto the sheet at a desired fixing temperature (for example, 170° C.).

The thermostat TH and the thermistor disposed in sheet conveyance spans for all sheet sizes are not affected by temperature rise at the end portion through which no sheet passes. Therefore, the thermostat TH can cut off a current at an early stage of abnormal heat generation due to a failure. The thermostat TH disposed at the end portion through which no sheet may pass needs a detection temperature for the abnormal heat generation to be set higher than the thermostat TH disposed in the sheet conveyance spans in order to prevent erroneous detection, which is disadvantageous in terms of safety.

The heater according to a second embodiment is described below.

Figure 3B:
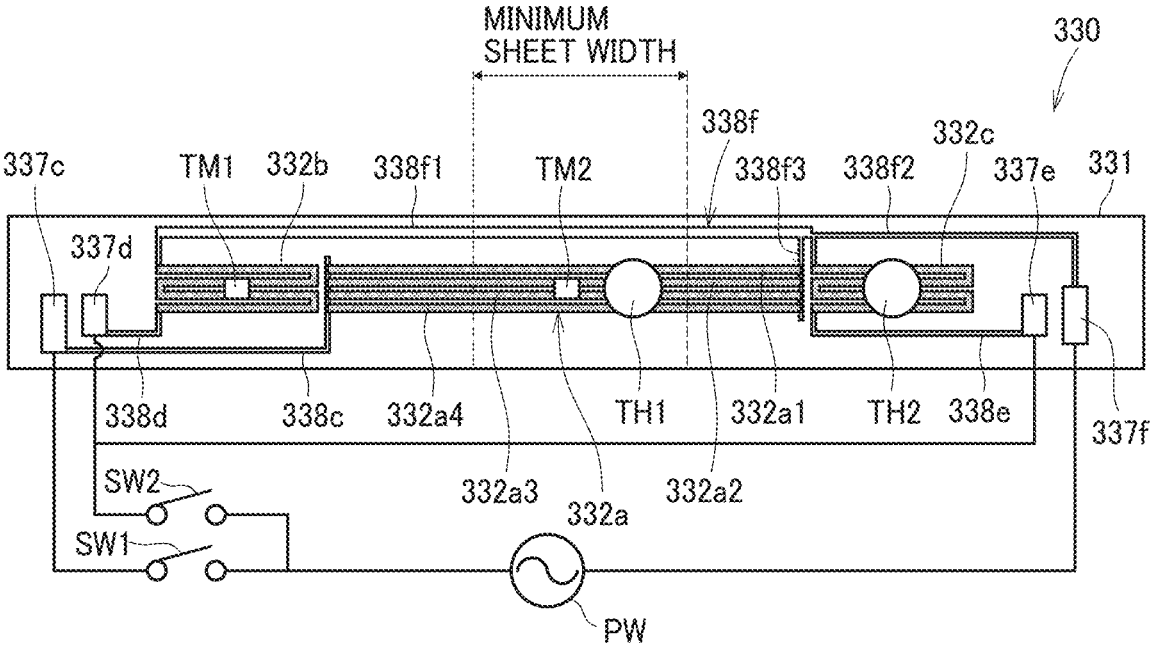
FIG. 3B is a plan view of the heater according to a second embodiment of the present disclosure.

FIG. 3B is a plan view of the heater 330 according to the second embodiment. The heater 330 includes three resistor patterns 332*a*, 332*b*, and 332*c* arranged in the longitudinal direction of the base 331. That is, the heater 330 includes the resistor pattern 332*a* disposed at a center portion of the base 331 in the longitudinal direction of the base 331 and the resistor patterns 332*b* and 332*c* disposed at both end portions of the base 331 in the longitudinal direction of the base 331.

The three resistor patterns 332*a*, 332*b*, and 332*c* can be formed by, for example, applying a resistive material paste having a certain specific resistance and prepared by mixing sifter-palladium (AgPd), glass powder, or the like to the base 331 by screen printing or the like, and then firing the base 331. Alternatively, the resistive material may be a silver alloy (AgPt) and ruthenium oxide ($RuO_2$). An example of a positive temperature coefficient of resistance of the resistive material may be 300 ppm.

Selecting and energizing the three resistor patterns 332*a*, 332*b*, and 332*c* to generate heat efficiently heats the sheet having various kinds of sheet sizes (for example, A3 size to A6 size). That is, when a large-size sheet such as a A3 sheet or a B4 sheet is conveyed and heated, all the resistor patterns 332*a*, 332*b*, and 332*c* are energized to generate heat. In contrast, when a small-size sheet such as A4, B5, A5, B6, or A6 sheet is conveyed and heated, only the resistor pattern 332*a* disposed at the center portion is energized to generate heat.

The resistor pattern 332*a* at the center portion in the longitudinal direction includes four rows of resistors 332*a*1 to 332*a*4 as first resistors extending linearly in the longitudinal direction of the base 331. The four rows of resistors 332*a*1 to 332*a*4 have the same lengths, widths, and thicknesses, and are arranged in parallel at equal intervals. Providing the four rows of resistors 332*a*1 to 332*a*4 can reduce the amount of heat generated per one row.

The resistor pattern 332*a* disposed at the center portion has a larger heat generation area than the resistor patterns 332*b* and 332*c* disposed at both end portions. Therefore, the resistor pattern 332*a* disposed at the center portion requires a large electric power, and conversely, the resistance value of the resistor pattern 332*a* needs to be small.

When a necessary heat generation amount of the entire of the resistor pattern 332*a* is 900 W, the amount of heat generated per one row is one fourth of the necessary heat generation amount 900 W, that is, 225 W. When a length of the resistor pattern 332*a* in the longitudinal direction is 216 mm, a heat generation density [W/mm] of the resistor pattern 332*a* in the longitudinal direction is 900 W/216 mm=4.17 W/mm, and a heat generation density [W/mm] of one row of the resistor pattern 332*a* is 225 W/216 mm=1.04 [W/mm].

On the other hand, the resistor patterns 332*b* and 332*c* at both end portions in the longitudinal direction, which will be described later, are continuously folded in a zigzag manner in the short-side direction of the base 331 to increase the total length of each of the resistor patterns 332*b* and 332*c* (that is, increasing each resistance value). When a length of each of the resistor patterns 332*b* and 332*c* in the longitudinal direction is 43 mm, a necessary heat generation amount of each of the resistor patterns 332*b* and 332*c* is calculated as follows. That is, since each of the resistor patterns 332*b* and 332*c* needs to have the same heat generation density [W/mm] in the longitudinal direction of the resistor pattern 332*a*, that is, 4.17 W/mm, the necessary heat generation amount of each of the resistor patterns 332*b* and 332*c* is 4.17 W/mm×43 mm=179 W.

When each of the resistor patterns 332*b* and 332*c* having the length 43 mm in the longitudinal direction has four rows that is formed by folding a pattern three times in the zigzag manner, the total length of each of the resistor patterns 332*b* and 332*c* is 43 mm×4=172 mm. The heat generation density [W/mm] of each of the resistor pattern 332*b* and 332*c* is 179 W/172 mm=1.04 [W/mm], which indicates that the three resistor patterns 332*a* to 332*c* can be formed of the same resistance material having the same specific resistance. Thus, the three resistor patterns 332*a* to 332*c* can be simultaneously screen-printed, which contributes to cost reduction.

Both ends in the longitudinal direction of the four rows of resistors 332*a*1 to 332*a*4 are coupled in parallel to the electrodes 337*c* and 337*f* via the conductors 338*c*, 338*f*2, and 338*f*3. The right electrode 337*f* is coupled to a terminal of the 100V AC power supply PW, and the other electrodes 337*c*, 337*d* and 337*e* are coupled to the other terminal of the 100V AC power supply PW via the switches SW1 and SW2.

Operating the switches SW1 and SW2 can separately switch on and off the resistor pattern 332*a* at the center portion and the resistor patterns 332*b* and 332*c* at both ends. The above-described configuration of the fixing device 300 enables switching off the power supply to the resistor patterns 332*b* and 332*c* corresponding to small sheet sizes that the resistor patterns 332*b* and 332*c* do not need to heat to improve energy saving performance of the fixing device 300. In addition, intermittently switching on the switch SW2 to energize the resistor patterns 332*b* and 332*c* at both end portions and intermittently heating both end portions of the fixing belt 310 can prevent temperature drop at both end portions of a sheet conveyance area of the fixing belt 310. The heat controller as circuitry included in the controller 101 controls the switches SW1 and SW2 to perform a first control that independently energize and de-energize the resistor pattern 332*a* at the center portion as a first resistor pattern and the resistor patterns 332*b* and 332*c* at both end portions as second resistor patterns and a second control that simultaneously energizes and de-energizes both the first resistor pattern and the second resistor patterns.

The above-described four rows of resistors 332*a*1 to 332*a*4 do not necessarily have to be linear as illustrated in FIG. 3B. Instead of the linear shape, the shapes of the resistors 332*a*1 to 332*a*4 may be shapes including waveforms continuously connected. Forming the resistors 332*a*1 to 332*a*4 to have the shapes including the waveforms can increase the lengths of the resistors 332*a*1 to 332*a*4 and enables reducing the specific resistance of the resistive material paste.

The thermostat TH1 is disposed across four rows of the resistors 332*a*1 to 332*a*4. The thermostat TH1 cuts off power supply to the four rows of resistors 332*a*1 to 332*a*4 for safety when the temperature of any one of the four rows of resistors 332*a*1 to 332*a*4 reaches the high temperature threshold (for example, higher than 180° C. and lower than 200° C.). That is, even if any one of the plurality of resistors 332*a*1 to 332*a*4 formed in the short-side direction is broken, the thermostat TH1 disposed on each of parts of resistors 332*a*1 to 332*a*4 that are always energized to generate heat can ensure security for excessive temperature rise due to abnormality.

Additionally, a thermistor TM1 is disposed in the vicinity of the thermostat TH1. The thermistor TM1 is disposed across resistors 332*a*2 and 332*a*3 that are the central two rows in the short-side direction among the four rows of resistors 332*a*1 to 332*a*4 considering a variation in setting the thermistor TM1 at its setting position. The thermostat TH1 and the thermistor TM1 are disposed substantially at the center of the base 331 in the longitudinal direction of the base 331. At the center of the base 331, the temperature rise at the end portion through which no sheet passes during printing small sheets does not affect temperatures detected by the thermostat TH1 and the thermistor TM1. Additionally, the thermostat TH1 and the thermistor TM1 are disposed in the range corresponding to the minimum sheet width in the image forming apparatus (for example, the A6 size sheet width).

Each of the resistor patterns 332*b* and 332*c* at both end portions in the longitudinal direction is continuously folded in the zigzag manner in the short-side direction of the base 331 and forms a second resistor. The width in the short-side direction of each of the resistor patterns 332*b* and 332*c* disposed at both end portions is the same as the width in the short-side direction of the resistor pattern 332*a* disposed at the center portion. The width in the longitudinal direction of each of the resistor patterns 332*b* and 332*c* is a fraction of the width in the longitudinal direction of the resistor pattern 332*a* disposed at the center portion.

The resistor patterns 332*b* and 332*c* each are folded in the zigzag manner to form four rows arranged in the short-side direction of the base 331. A line width and thickness of each of the resistor patterns 332*b* and 332*c* disposed at both end portions are set so that a resistance value distribution (that means a heat generation distribution) in the longitudinal direction of the base 331, including the resistor pattern 332*a*, becomes uniform.

Folding each of the resistor patterns 332*b* and 332*c* in the zigzag manner increases the length of each of the resistor patterns 332*b* and 332*c*, reduces the specific resistance of the resistance material paste, and decreases unevenness of the temperature distribution in the short-side direction of each of the resistor patterns 332*b* and 332*c*. Forming the resistor patterns 332*b* and 332*c* as one row pattern that are not folded in the zigzag manner in the short-side direction is not preferable because the one row pattern generates a locally high temperature portion.

The thermistor TM2 is disposed across the second row and the third row of the resistor pattern 332*b* disposed at one end portion of the base 331 (the left end portion of the base 331). The position of the thermistor TM2 in the longitudinal direction of the resistor pattern 332*b* is substantially the center of the resistor pattern 332*b*. Disposing the thermistor TM2 at the center position of the resistor pattern 332*b* enables the thermistor TM2 to accurately detect the temperature of the resistor pattern 332*b*.

On the other hand, the thermostat TH2 is disposed across all of the first to fourth rows of the resistor pattern 332*c* disposed at the other end portion of the base 331 (the right end portion of the base 331). The position of the thermostat TH2 in the longitudinal direction of the resistor pattern 332*c* does not necessarily have to be the center of the resistor pattern 332*c*.

Based on temperatures detected by the thermistors TM1 and TM2, the heat controller included in the controller 101 controls power supplied to the heater 330 to control the temperature of the fixing belt 310 to a desired temperature. The heat controller is an example of circuitry. For example, the heat controller (e.g., a processor) is a microcomputer including a central processing unit (CPU), a read-only memory (ROM), a random-access memory (RAM), and an input-output (I/O) interface. When a sheet is conveyed through the fixing nip N, for example, the heat controller controls the temperature of the fixing belt 310 to the desired temperature with an appropriate input of additional power in consideration of the heat removed by the sheet conveyed through the fixing nip N, in addition to the temperatures detected.

The heater according to a third embodiment is described below.

Figure 3C:
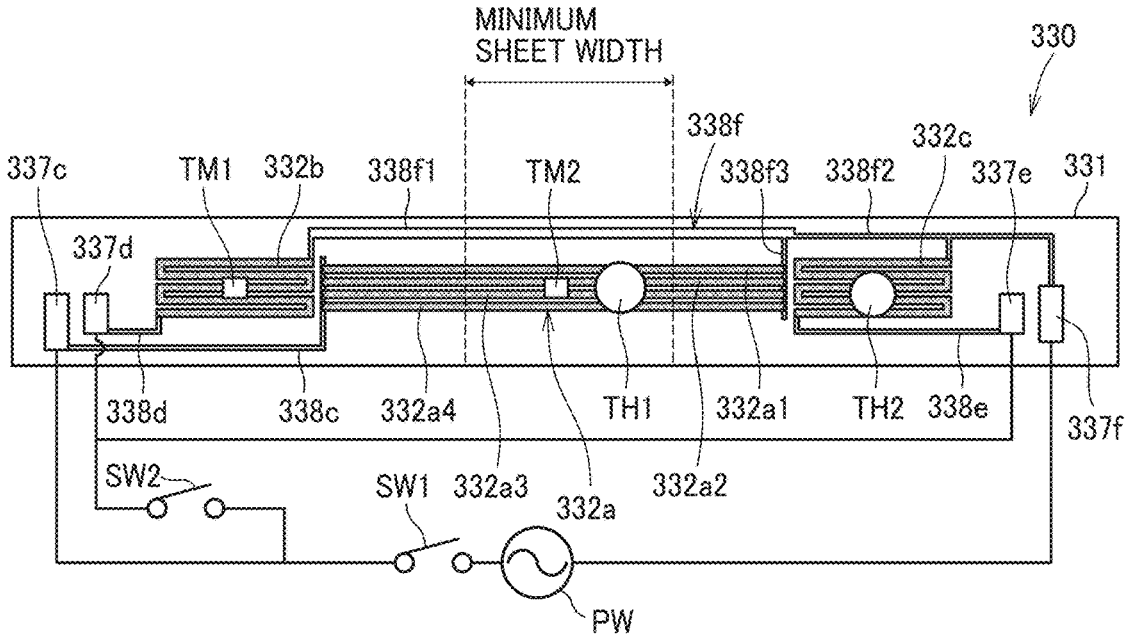
FIG. 3C is a plan view of the heater according to a third embodiment of the present disclosure.

FIG. 3C is a plan view of the heater 330 according to the third embodiment that is a variation of the heater 330 in FIG. 3B. Following three points 1) to 3) are different from the heater 330 in FIG. 3B.

1) Coupling manner of the switches SW1 and SW2 is changed from a parallel connection to a serial connection, and the switch SW2 is coupled to a point between the switch SW1 and the electrode 337*c*.

2) The number of rows of each of the resistor patterns 332*b* and 332*c* disposed at right and left end portions and formed by folding in the zigzag manner is increased from four to five.

3) The thermostat TH2 disposed facing the resistor pattern 332*c* at the right end portion is reduced in size (diameter) and moved downward.

Changing the position of the switch SW1 enables switching between an ON-OFF control of the resistor pattern 332*a* disposed at the center portion and an ON-OFF control of the resistor patterns 332*a* to 332*c* corresponding to the entire width of the maximum sheet size. Increasing the number of rows formed by folding the resistor pattern in the zigzag manner from four to five can increase the heat generation area of the resistor pattern in the short-side direction, preventing the temperature drop tendency at both end portions of the sheet conveyance area of the fixing belt 310.

Regarding the size and position of the thermostat TH2, the thermostat TH2 of the heater 330 in FIG. 3B is disposed across the four rows of the resistor pattern 332*c* from the first row to the fourth row, but in contrast, the thermostat TH2 in FIG. 3C is disposed across the four rows of the resistor pattern 332*c* from the second row to the fifth row.

As described above, the manner of temperature rise of the resistor pattern 332*c* caused by a failure is the same at all positions of the resistor pattern 332*c*. Accordingly, the thermostat TH2 in FIG. 3C may have a slightly smaller radius than the thermostat TH2 in FIG. 3B and be disposed across the rows from the second row to the fifth row in the resistor pattern 332*c* so as not to face the first row in the resistor pattern 332*c*. Reducing the radius of the thermostat TH2 can save space and reduce a weight of the fixing device and a production cost of the fixing device.

The heater according to a comparative embodiment is described below.

Figure 3D:
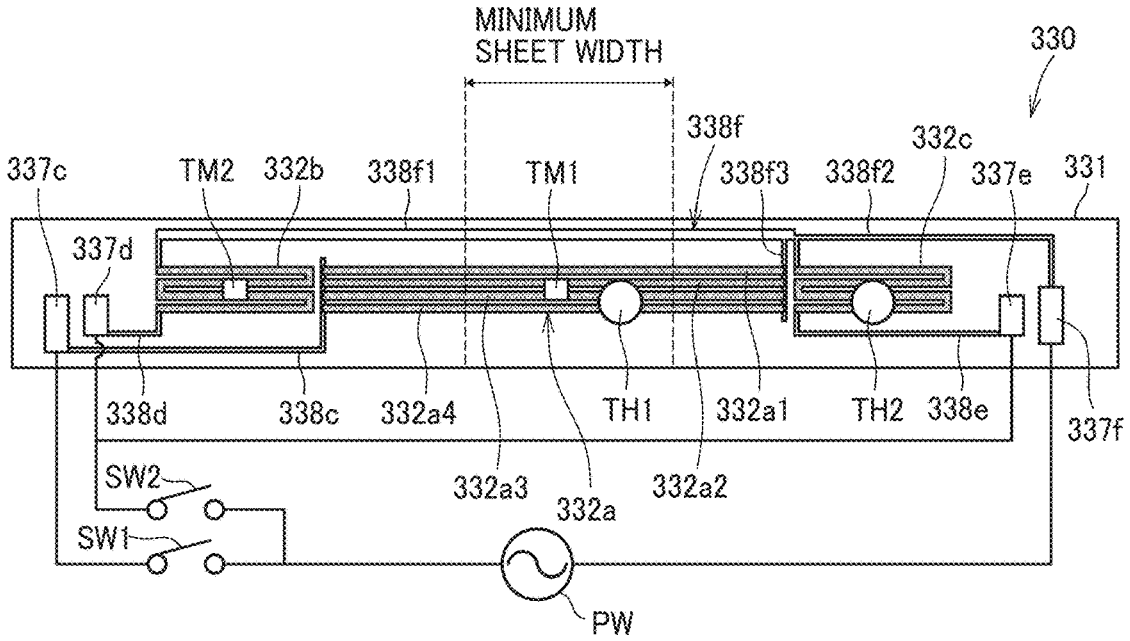
FIG. 3D is a plan view of the heater according to a comparative embodiment.
Figure 3E:
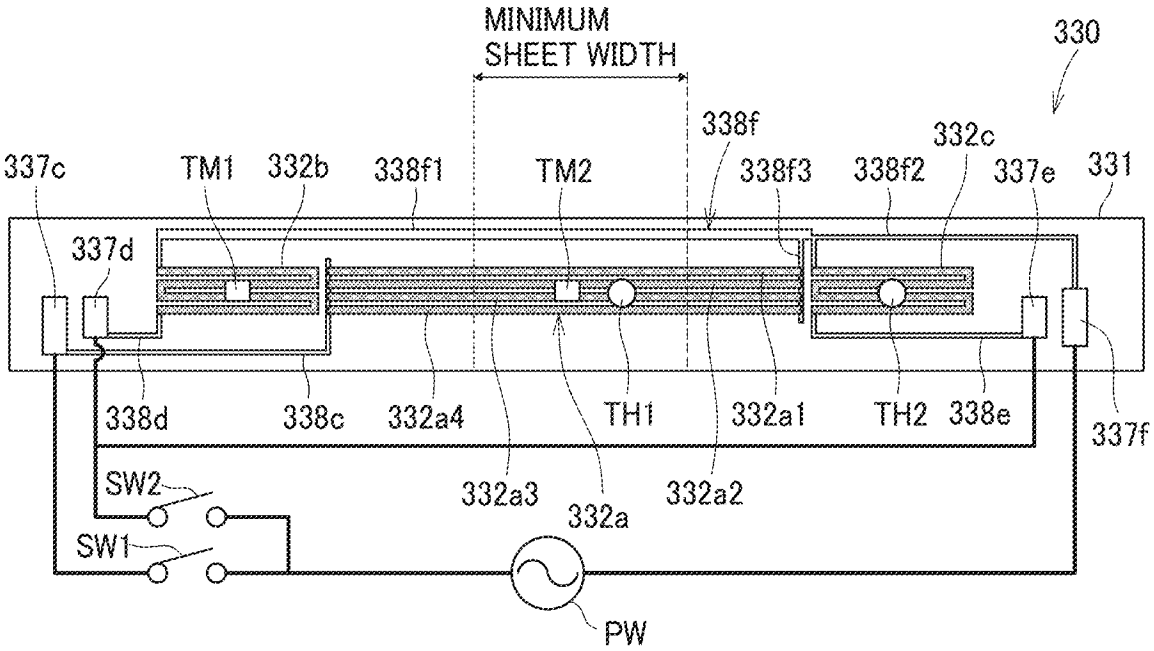
FIG. 3E is a plan view of the heater according to another comparative embodiment.

Arrangements of the thermostat TH1 as illustrated in FIGS. 3D and 3E include the resistor not facing the thermostat TH1. In FIG. 3D, the position of the thermostat TH1 at the center is slightly shifted downward, and the first row of resistor 332*a*1 does not face the thermostat TH1. In FIG. 3E, since the thermostat TH1 at the center has a small outer radius, the thermostat TH1 does not face the first row of resistor 332*a*1 and the fourth row of resistor 332*a*4.

Even if any one of the resistors in FIGS. 3D and 3E is broken due to a failure, the other resistors are energized because the four rows of resistors 332*a*1 to 332*a*4 are coupled in parallel. For this reason, even if the first row of resistor 332*a*1 in FIG. 3D abnormally generates heat and is broken or at least one of the first row of resistor 332*a*1 and the fourth row of resistor 332*a*4 in FIG. 3E abnormally generates heat and is broken, the temperature detected by the thermostat TH1 does not rise or the temperature rising speed thereof becomes slow. Therefore, when a short circuit of a triac or a runaway of the CPU occurs in the above-described states, the thermostat TH1 cannot immediately cut off the current.

In contrast, the thermostat TH2 facing the resistor pattern 332*c* disposed at the right end portion is different from the thermostat TH1. The thermostat TH2 always detects abnormal heat generation in the resistor pattern 332*c* and cuts off the current even if the thermostat TH2 is displaced downward as the thermostat TH1 illustrated in FIG. 3D or has the small outer radius as the thermostat TH1 illustrated in FIG. 3E.

Next, embodiments about arrangements of the thermostat are described below.

Figure 4A:
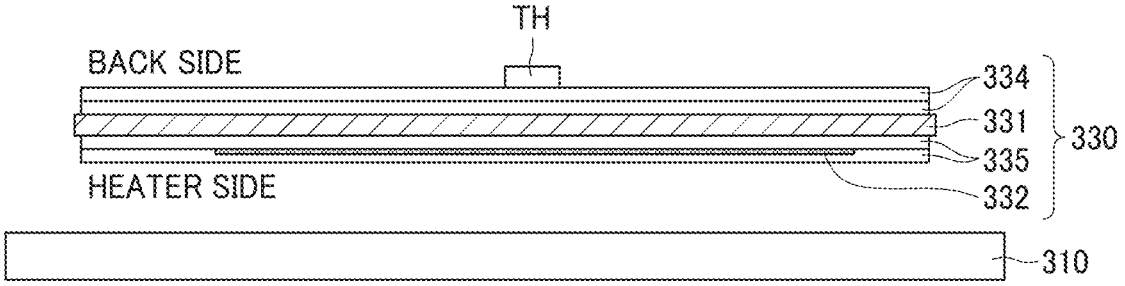
FIGS. 4A to 4C are cross-sectional views of the heater with different arrangements of a thermostat.
Figure 4B:
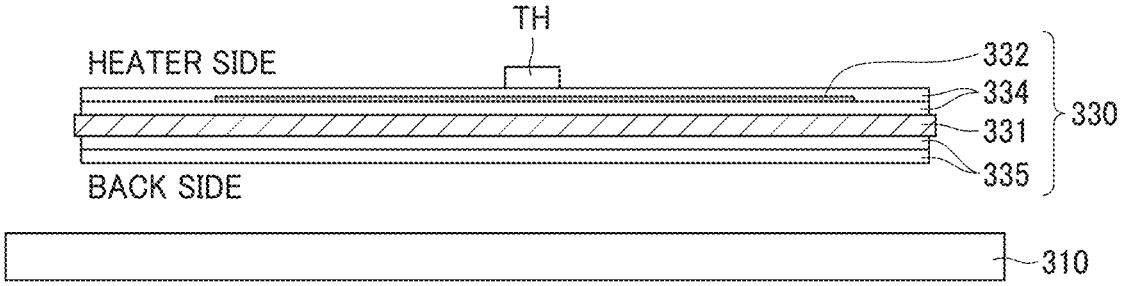
Figure 4C:
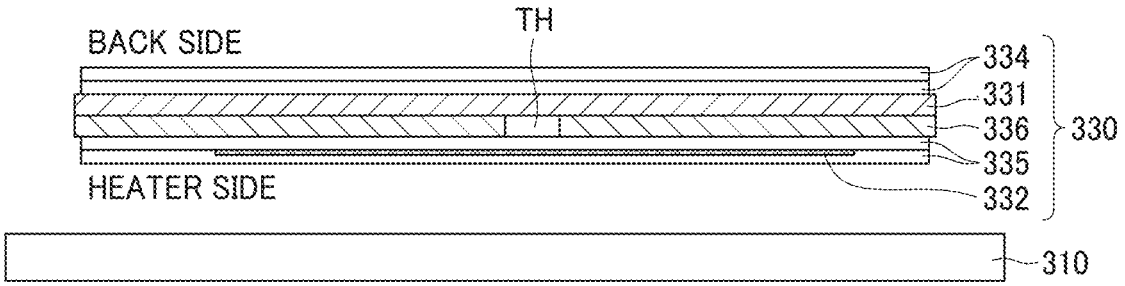

FIGS. 4A to 4C are cross-sectional views of the heater 330 with different arrangements of the thermostat TH. In the arrangement of the embodiment illustrated in FIG. 4A, the resistor 332 is disposed near a side of the base 331 facing the fixing belt 310, and the thermostat TH is disposed near the other side of the base 331 that is opposite to the side near the resistor 332. That is, the thermostat TH is disposed on the back side of the heater 330 opposite to the heater side of the heater 330 that is the side including the resistor 332.

Stacked two layers 334 made of insulating glass are between the thermostat TH and the base 331. The upper and lower sides of the resistor 332 are sandwiched by insulating glass layers 335.

In the arrangement of the embodiment illustrated in FIG. 4B, the resistor 332 and the thermostat TH are disposed near the other side of the base 331 that is opposite to the side of the base 331 facing the fixing belt 310. That is, the thermostat TH is disposed on the heater side of the heater 330 including the resistor 332, and the back side of the heater 330 opposite the heater side faces the fixing belt 310.

In the arrangement of the embodiment illustrated in FIG. 4C, the resistor 332 and the thermostat TH are disposed near the side of the base 331 facing the fixing belt 310. That is, the thermostat TH is disposed on the heater side of the heater 330 including the resistor 332.

In FIG. 4C, a thermal insulation layer 336 is interposed between the base 331 and the resistor 332, and the thermostat TH is fitted into a notch hole formed in the thermal insulation layer 336. As described above, the thermostat TH may be disposed at any one of positions illustrated in FIGS. 4A to 4C.

Figure 4D:
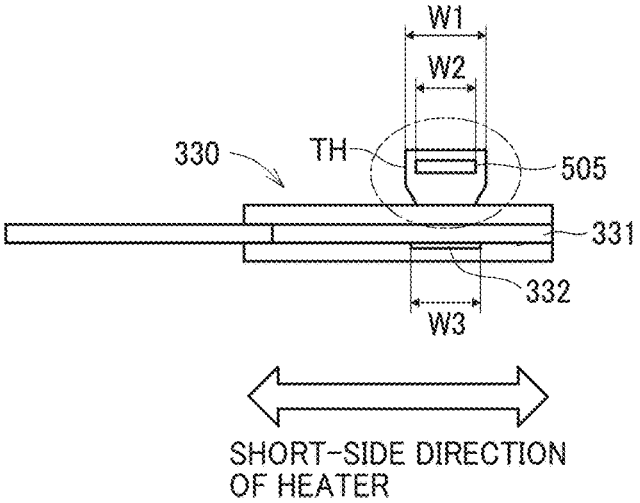
FIG. 4D is a schematic cross-sectional view of the heater, illustrating a positional relation between the thermostat and a resistor pattern.
Figure 4E:
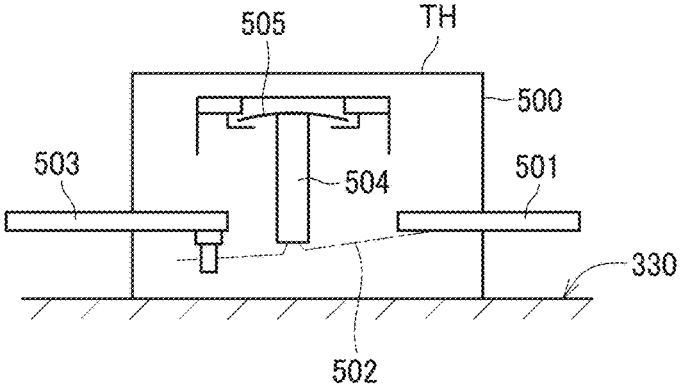
FIG. 4E is a schematic cross-sectional view of the thermostat, illustrating the internal configuration of the thermostat.
Figure 4F:
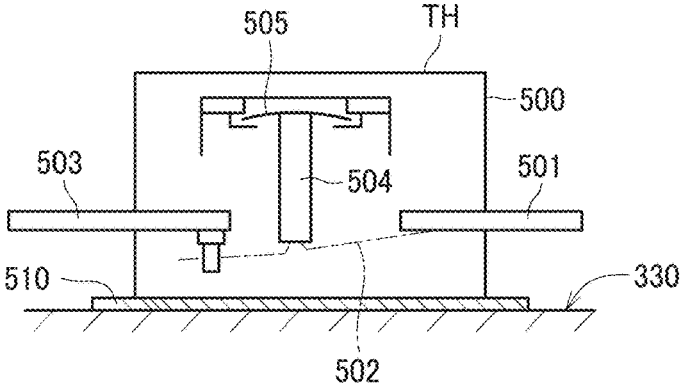
FIG. 4F is a schematic cross-sectional view of the thermostat that a heat conduction plate is added.

Next, embodiments about structures of the thermostat TH are described. FIG. 4D is a schematic cross-sectional view of the heater, illustrating a positional relation between the thermostat TH and the resistor 332. FIGS. 4E and 4F are schematic cross-sectional views of the thermostat TH illustrating the structure of the thermostat TH. The thermostat TH includes a main body case 500 that abuts on the heater 330. A disc-shaped or bowl-shaped bimetal 505 accommodated in the main body case 500 reacts to the heat generated by the heater 330.

Preferably, a width W3 of the resistor 332 in the short-side direction of the heater 330 is smaller than a width W1 of the main body case 500 in the short-side direction of the heater 330, that is, W3<W1, and more preferably, a width (radius) W2 of the bimetal 505 in the short-side direction of the heater 330 is larger than the width W3 of the resistor 332 and smaller than the width W1 of the main body case 500, that is, W3<W2<W1. Setting W3<W2 in the short-side direction of the heater 330 enables the bimetal 505 to receive heat from the resistor 332 without escaping the heat.

Dimensions of the thermostat TH of the present embodiment are as follows. The width of the main body case 500 in contact with the heater 330 in the short-side direction of the heater 330: 7 to 8 mm (a provisional value: 7.5 mm). The width of the bimetal 505 in the short-side direction: 5 to 7 mm (a provisional value: 6.0 mm).

FIGS. 4E and F illustrate the internal structure of the thermostat TH. The thermostat TH includes the main body case 500, a first terminal 501, a contact 502, a second terminal 503, an ejecting rod 504 fixed on the upper face of the contact 502, and a bimetal 505 disposed on a ceiling portion of the main body case 500.

The contact 502 has a base end supported by the first terminal 501. The contact 502 is biased upward due to the elasticity of the contact 502. The ejecting rod 504 connects the contact 502 and the center of the lower surface of the bimetal 505. A high temperature higher than a predetermined high temperature threshold (for example, higher than 180° C. and lower than 200° C.) changes the shape of the bimetal 505 from an upward convex shape to a downward convex shape. This change in the bimetal 505 pushes the ejecting rod 504 downward, and the ejecting rod 504 pushes the contact 502 downward. As a result, the contact 502 disconnects the first terminal 501 and the second terminal 503.

As illustrated in FIG. 4F, a heat conduction plate 510 may be disposed between the thermostat TH and the heater 330, if necessary. Since the heat conduction plate 510 collects heat in the short-side direction of the heater 330 and transmits the heat to the bimetal 505, the heat conduction plate 510 can improve the responsiveness of the thermostat TH and increase a response area of the thermostat TH.

The following describes adjusting resistance values of conductors coupling to resistor patterns to reduce unevenness in a heat generation distribution.

Figure 5A:
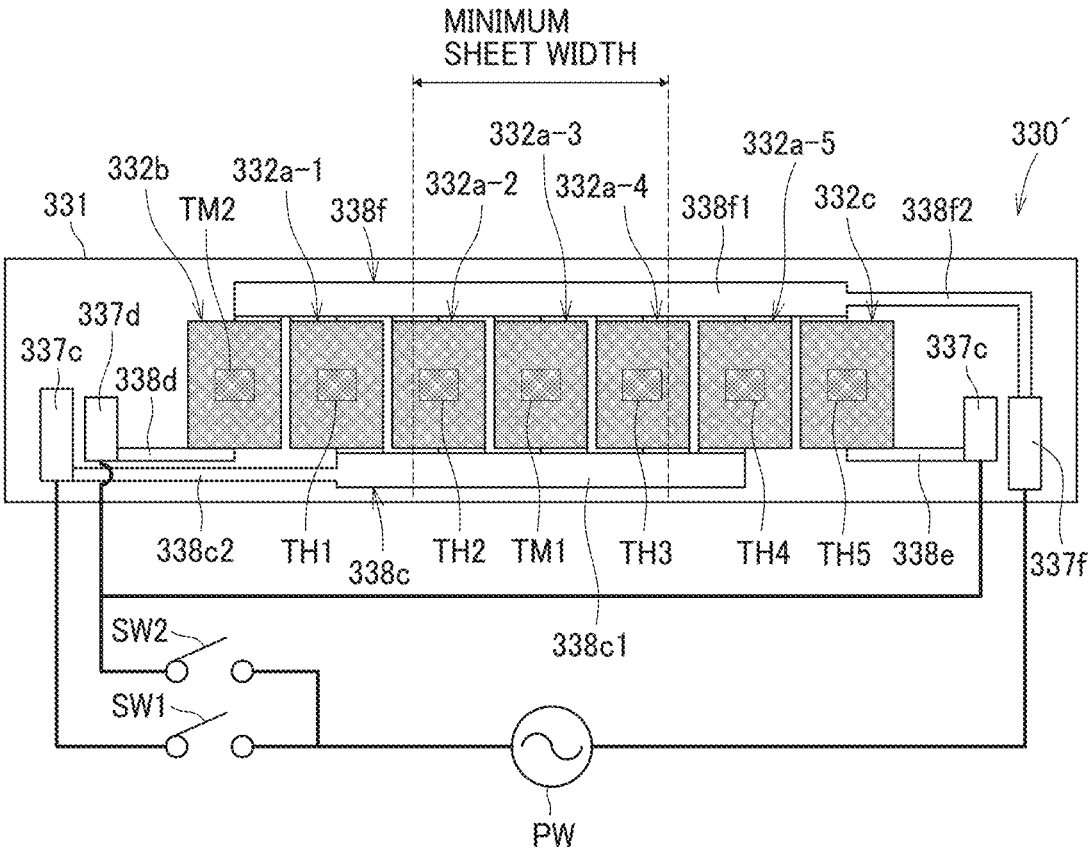
FIG. 5A is a plan view of the heater according to a still another comparative embodiment.

FIG. 5A is a plan view of the heater 330' according to a comparative embodiment in which thermistors TM1 and TM2 and thermostats TH1 to TH5 are arranged.

Figure 5B:
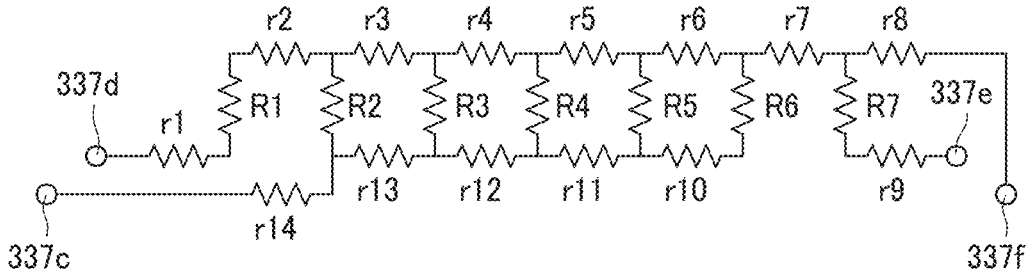
FIG. 5B is an equivalent electric circuit diagram of the heater in FIG. 5A.

FIG. 5B is an equivalent electric circuit diagram of the heater in FIG. 5A. In FIG. 5B, resistance values R1 to R7 indicate resistance values of resistor patterns 332*a*-1 to 332*a*-5, 332*b*, and 332*c*, respectively, and resistance values r1 to r14 indicate resistance values of conductors 338*d* (r1), 338*f*1 (r2 to r8), 338*e* (r9), 338*c*1 (r10 to r13), and 338*c*2 (r14), respectively.

When the resistor patterns 332*a*-1 to 332*a*-5, 332*b*, and 332*c* are referred to as heat generators 1 to 7 for the sake of simplicity, the following equations mean electric resistance values of circuits from one of the electrodes 337*c* and 337*d* to one of the electrodes 337*e* and 337*f* through each of the heat generators 1 to 7. That is:

The heat generator 1: r1+R1+r2+r3+r4+r5+r6+r7+r8, The heat generator 2: r14+R2+r3+r4+r5+r6+r7+r8, The heat generator 3: r14+r13+R3+r4+r5+r6+r7+r8, The heat generator 4: r14+r13+r12+R4+r5+r6+r7+r8, The heat generator 5: r14+r13+r12+r11+R5+r6+r7+r8, The heat generator 6: r14+r13+r12+r11+r10+R6+r7+r8, and The heat generator 7: r8+R7+r9.

A total length of the conductors in the circuit passing through the resistor pattern 332*b* disposed at the left end is longer than a total length of the conductors in the circuit passing through the resistor pattern 332*c* at the right end. Therefore, if the conductors 338*c*2, 338*c*1, 338*d*, 338*e*, and common conductor 338*f* have the same resistivity, the resistance value of the circuit passing through the resistor pattern 332*b* is larger than the resistance value of the circuit passing through the resistor pattern 332*c* by a resistance value (r2+r3+r4+r5+r6+r7). As a result, when the switch SW2 is switched on, the heat generation amount of the resistor pattern 332*b* at the left end is relatively smaller than the heat generation amount of the resistor pattern 332*c* at the right end. That is, the difference between heat generation amounts at the both ends occurs.

Similarly, each of total lengths of conductors in five circuits passing through each of the five resistor patterns 332*a*-1 to 332*a*-5 in a center portion of the heater is longer than the total length of the conductors in the circuit passing through the resistor pattern 332*c* at the right end. Therefore, each of the resistance values of the five circuits is larger than the resistance value of the circuit passing through the resistor pattern 332*c*. As a result, when the switch SW1 and the switch SW2 are switched on, the heat generation amount of each of the resistor patterns 332*a*-1 to 332*a*-5 is smaller than the heat generation amount of the resistor pattern 332*c* at the right end. That is, the unevenness in the heat generation distribution occurs in the longitudinal direction of the heater.

To reduce the above-described unevenness, common conductors 338*c* and 338*f* that connect to the resistor patterns 332*a*-1 to 332*a*-5, 332*b*, and 332*c* are designed to have smaller resistance values than resistance values of other conductors as illustrated in FIG. 5A. Specifically, as illustrated in FIG. 5A, the conductors 338*c*1 and 338*f*1 are widened.

Instead of widening the conductors 338*c*1 and 338*f*1, or in addition to widening the conductors 338*c*1 and 338*f*1, the heights (thicknesses) of the conductors may be increased, or the conductors 338*c*1 and 338*f*1 may be made of material having low resistivity. The above can reduce the unevenness in the heat generation distribution generated by the resistor patterns 332*a*-1 to 332*a*-5, 332*b*, and 332*c*.

The above-described countermeasure is applied to the heaters illustrated in FIGS. 3B and 3C. Forming the width of a main body conductor 338*f*1 of the common conductor 338*f* larger than the width of a right portion conductor 338*f*2 can reduce unevenness in the heat generation distribution in the longitudinal direction of the heater. Note that the resistance value of a branch portion conductor 338*f*3 can be ignored because the branch portion is short and does not affect the unevenness in the heat generation distribution.

As described above, the heater 330' according to the comparative embodiment basically includes the thermostats TH1 to TH5 facing five resistor patterns of the seven resistor patterns 332*a*-1 to 332*a*-5, 332*b*, and 332*c*, respectively, that is, the thermostats TH1 to TH5 facing all resistor patterns other than resistor patterns facing the thermistors TM1 and TM2. That is, the heater 330' includes the five resistor patterns 332*a*-1 to 332*a*-5 coupled in parallel in an area corresponding to the resistor pattern 332*a* disposed at the center portion in the longitudinal direction of the heater 330'. Accordingly, the heater 330' must basically include the temperature detectors or safety elements corresponding to the total number of seven resistor patterns.

As a result, many number of the temperature detectors and the safety elements causes not only increase of the cost of the heater 330' but also a complicated temperature control based on many temperatures detected by the plurality of temperature detectors. In contrast, since the heater 330 in the present embodiment illustrated in each of FIGS. 3B and 3C includes a heat generation portion configured by the resistor pattern 332*a* as the first resistor pattern and the resistor pattern 332*b* and 332*c* as the second resistor patterns, the number of safety elements may be at least two, and three safety elements can be reduced as compared with FIG. 5A.

That is, the heater 330 according to the present embodiment includes one thermostat TH1 in an area of the resistor pattern 332*a* as the first resistor pattern, for example, at a center portion of the area of the resistor pattern 332*a* and the other one thermostat TH2 disposed at an arbitrary position in an area of one of the right and left resistor patterns (for example, the resistor pattern 332*c*). The above-described heater 330 can be reduced in space, weight, and cost.

Figure 6:
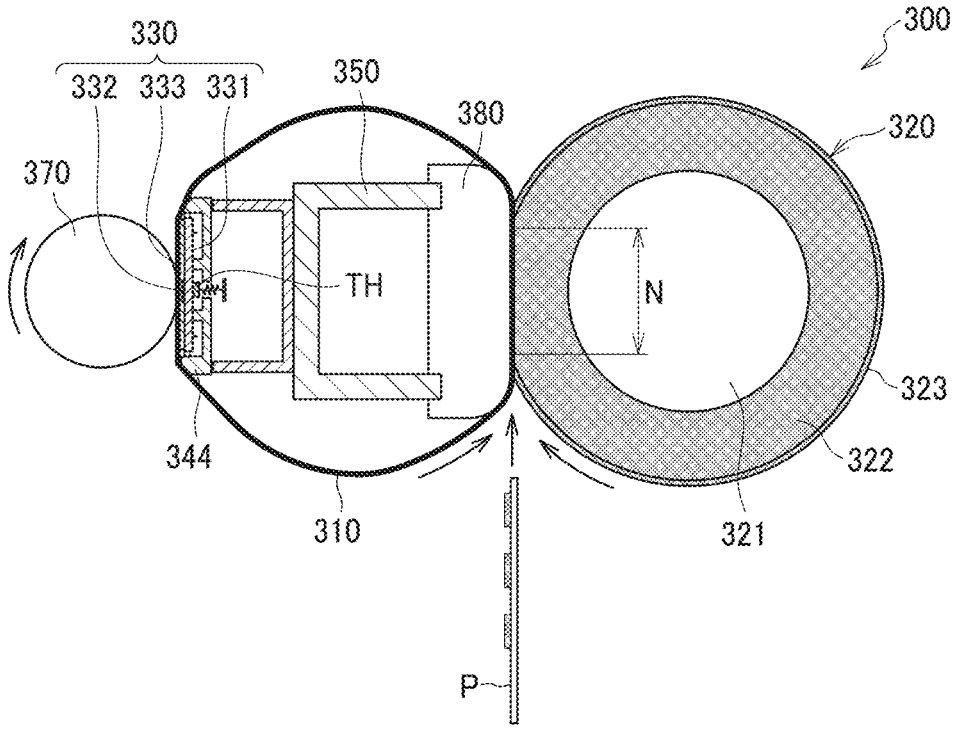
FIG. 6 is a cross-sectional view of a first variation of the fixing device.
Figure 7:
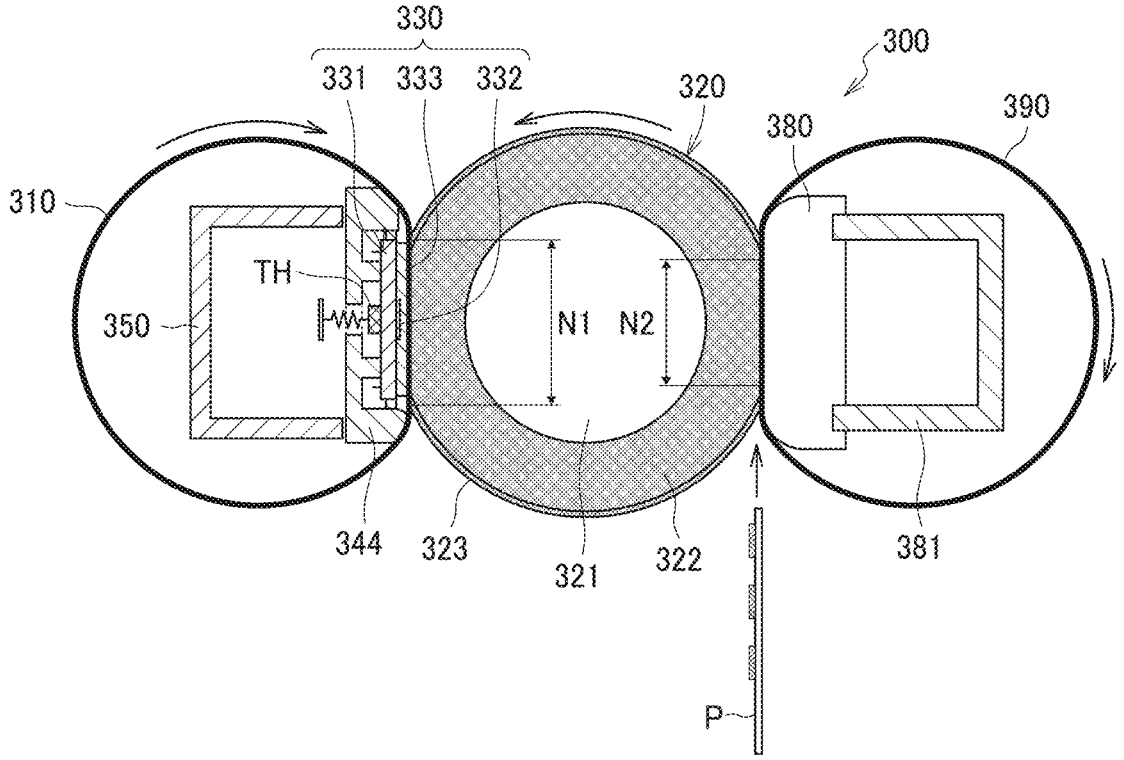
FIG. 7 is a schematic cross-sectional view of a second variation of the fixing device.

In addition to the above-described fixing device 300, the present embodiment may be also applicable to a fixing device 300 as illustrated in FIGS. 6 and 7.

The fixing device 300 illustrated in FIG. 6 includes a pressurization roller 370 opposite the pressure roller 320 with respect to the fixing belt 310 and heats the fixing belt 310 sandwiched by the pressurization roller 370 and the healer 330.

On the other hand, a nip formation pad 380 serving as a nip former is disposed inside the loop formed by the fixing belt 310 and disposed opposite the pressure roller 320. The stay 350 supports the nip formation pad 380. The nip formation pad 380 and the pressure roller 320 sandwich the fixing belt 310 and define the fixing nip N.

The fixing device 300 illustrated in FIG. 7 includes a pressing belt 390 in addition to the fixing belt 310 and has a heating nip (a first nip) N1 and the fixing nip (a second nip) N2 separately. That is, the nip formation pad 380 and the stay 381 are disposed opposite the fixing belt 310 with respect to the pressure roller 320, and the pressing belt 390 is rotatably arranged to wrap around the nip formation pad 380 and the stay 381.

The sheet P passes through the fixing nip N2 between the pressing belt 390 and the pressure roller 320 and is applied to heat and pressure, and the image is fixed on the sheet P. Other configurations of the fixing device is equivalent to that of the fixing device 300 depicted in FIG. 2B.

Although various heaters 330 and fixing devices 300 are described above, the present disclosure is not limited to the above-described embodiments, and various variations can be made. For example, the circuit breaker is not limited to the thermostat, and a temperature fuse or the like may be used instead of the thermostat. In addition, the temperature detector may be a detector using a characteristic value change due to temperature characteristics such as a diode or a transistor instead of a detector using a semiconductor whose resistance value changes due to a temperature change, such as the thermistor.

The heater according to the present disclosure may be applied not only to the fixing device including a thin fixing belt directly heated but also to a fixing device including a heat roller which a heater is disposed inside. The heater according to the present disclosure is not applied only to the fixing device. For example, the heaters according to the embodiments of the present disclosure are also applicable to a heater in an ink jet print head and a dryer installed in an image forming apparatus employing an inkjet method. The dryer dries ink applied onto a sheet.

Alternatively, the heaters according to the embodiments of the present disclosure may be applied to a coater (e.g., a laminator) that thermally presses film as a coating member onto a surface of a sheet (e.g., paper) while a belt conveys the sheet. The heaters according to the embodiments of the present disclosure are not limited to applying a belt heating device that heats a belt and may be applied to a heating device that does not incorporate the belt.

The number of the resistors 332*a*1 to 332*a*4 as first resistors in the resistor pattern 332*a* as the first resistor pattern may be increased or decreased if necessary. The resistor pattern 332*a* may include a plurality of resistor patterns arranged in the longitudinal direction in addition to only one resistor pattern disposed at the center portion in the longitudinal direction of the base 331. For example, the number of the resistor patterns may be equal to or smaller than the number of resistor patterns described in the comparative embodiment.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention. Each of the functions of the described embodiments may be implemented by one or more processing circuits or circuitry. Processing circuitry includes a programmed processor, as a processor includes circuitry. A processing circuit also includes devices such as an application specific integrated circuit (ASIC), a digital signal processor (DSP), a field programmable gate array (FPGA), and conventional circuit components arranged to perform the recited functions.

What is claimed is:

1. A heater comprising: a base; a resistor pattern including a plurality of rows of resistors extending in a longitudinal direction of the base, the plurality of rows of resistors being spaced away from each other in a short-side direction orthogonal to the longitudinal direction of the base, being coupled in parallel, and being configured to generate heat by energization; and a circuit breaker centered in the short-side direction among the plurality of rows of resistors and having a width greater than that of the plurality of rows of resistors in the short-side direction such that the circuit breaker is disposed across the plurality of rows of resistors in the short-side direction and configured to cut off power supply to the resistor pattern when a temperature of any one of the plurality of rows of resistors reaches a high temperature threshold.

2. The heater according to claim 1, wherein each of the plurality of rows of resistors has a straight-line form extending in the longitudinal direction of the base.

3. The heater according to claim 1, further comprising a temperature detector facing the resistor pattern and configured to detect a temperature of the resistor pattern.

4. The heater according to claim 3, further comprising an elastic member configured to push the temperature detector against the base.

5. A heating device comprising:

a heating rotator configured to contact the heater according to claim 3 and to be heated by the heater, and a pressure rotator, wherein the heating rotator and the pressure rotator contact each other to form a nip through which a plurality of sheets having a plurality of sizes passes, wherein the circuit breaker is disposed in a range corresponding to a minimum sheet width of the plurality of sheets, and wherein the temperature detector faces a side of the base opposite the other side of the base facing the heating rotator.

6. The heater according to claim 1, further comprising an elastic member configured to push the circuit breaker against the base.

7. The heater according to claim 1, wherein first ends of each row of the plurality of rows of resistors are directly connected together via a first conductor, and second ends of each row of the plurality of rows of resistors are directly connected together via a second conductor.

8. The heater according to claim 7, wherein a connection between a first one of the rows of the plurality of rows of resistors and a second one of the rows of the plurality of resistors via the first conductor and the second conductor is fixed.

9. A heating device comprising:

a heating rotator configured to contact the heater according to claim 1 and to be heated by the heater, and a pressure rotator, wherein the heating rotator and the pressure rotator contact each other to form a nip through which a plurality of sheets having a plurality of sizes passes, and wherein the circuit breaker is disposed in a range corresponding to a minimum sheet width of the plurality of sheets.

10. The heating device according to claim 9, wherein the circuit breaker faces a side of the base opposite the other side of the base facing the heating rotator.

11. A heating device comprising:

a rotator having a sleeve-shape and flexibility;

the heater according to claim 1 configured to be slidable on an inner circumferential surface of the rotator; and a pressure rotator configured to press the heater via the rotator and form a nip between the rotator and the pressure rotator.

12. A fixing device comprising the heating device according to claim 11.

13. An image forming apparatus comprising:

a sheet feeder;

an image forming unit;

a transfer device; and the fixing device according to claim 12.

* * * * *